US011763642B2

(12) United States Patent
Lewis et al.

(10) Patent No.: US 11,763,642 B2
(45) Date of Patent: Sep. 19, 2023

(54) ANIMAL ACOUSTIC AUGMENTATION SYSTEMS AND METHODS

(71) Applicant: Chill Puppy LLC, Portland, OR (US)

(72) Inventors: James Shaker Lewis, Portland, OR (US); Benjamin Hanley Lewis, Portland, OR (US); Christopher John Lewis, Portland, OR (US); Gerald Hanley Lewis, Sagle, ID (US)

(73) Assignee: Chill Puppy LLC, Portland, OR (US)

( * ) Notice: Subject to any disclaimer, the term of this patent is extended or adjusted under 35 U.S.C. 154(b) by 0 days.

(21) Appl. No.: 17/566,441

(22) Filed: Dec. 30, 2021

(65) Prior Publication Data

US 2022/0198887 A1 Jun. 23, 2022

Related U.S. Application Data

(63) Continuation of application No. 17/189,183, filed on Mar. 1, 2021, now Pat. No. 11,217,072.

(60) Provisional application No. 62/982,674, filed on Feb. 27, 2020.

(51) Int. Cl.

| | |
|---|---|
| ***G08B 3/00*** | (2006.01) |
| ***G08B 21/18*** | (2006.01) |
| ***G08C 17/02*** | (2006.01) |

(52) U.S. Cl.

CPC ..... *G08B 3/00* (2013.01); *G08B 21/18* (2013.01); *G08C 17/02* (2013.01)

(58) Field of Classification Search

CPC ..... G08B 3/00; G08B 21/18; G08C 17/02
USPC ..... 340/539.11
See application file for complete search history.

(56) References Cited

U.S. PATENT DOCUMENTS

| | | | | |
|---|---|---|---|---|
| 8,783,212 | B2 * | 7/2014 | Bellon | A01K 27/009 119/859 |
| 9,628,895 | B2 * | 4/2017 | Malaviya | H04R 1/105 |
| 9,818,896 | B1 | 11/2017 | De Lyon et al. | |
| 10,362,766 | B2 * | 7/2019 | Bellon | A01K 27/001 |
| 10,743,523 | B1 * | 8/2020 | Heintzelman | H04L 67/60 |
| 11,062,572 | B1 * | 7/2021 | Zhang | G08B 21/18 |
| 11,272,274 | B1 * | 3/2022 | Liu | H04R 1/025 |

(Continued)

OTHER PUBLICATIONS

International Search Report and Written Opinion dated Oct. 21, 2020 in Intl Application No. PCT/US2020/039699 (11 pages).

*Primary Examiner* — Omar Casillashernandez
(74) *Attorney, Agent, or Firm* — Haynes and Boone, LLP

(57) ABSTRACT

Embodiments described herein provide an animal acoustic augmentor (AAA) for an animal acoustic augmentation system. The AAA includes an audio system configured to generate audio proximal and/or for delivery to an ear of an animal and a logic device configured to communicate with and control operation of the audio system. The logic device is configured to detect an AAA trigger associated with operation of the AAA and/or the audio system and generate an animal-audible trigger response via the audio system of the AAA based, at least in part, on the detected AAA trigger, where the animal-audible trigger response includes a pre-programmed AAA trigger response stored within a memory of the AAA and/or a live AAA trigger response based, at least in part, on a control sequence and/or an owner command provided by a personal electronic device associated with the AAA and/or an acoustic environment of the animal.

20 Claims, 5 Drawing Sheets

(56) References Cited

U.S. PATENT DOCUMENTS

| | | | | |
|---|---|---|---|---|
| 2012/0247401 | A1* | 10/2012 | Nolet | A01K 27/009 119/859 |
| 2016/0015004 | A1* | 1/2016 | Bonge, Jr. | A01K 15/02 119/718 |
| 2020/0060219 | A1* | 2/2020 | Levin | A01K 1/033 |
| 2020/0068852 | A1* | 3/2020 | Ramsay | A01K 29/005 |
| 2021/0022320 | A1* | 1/2021 | Allen | A01K 11/008 |
| 2021/0153461 | A1* | 5/2021 | Ferland | H04R 1/1016 |
| 2021/0233508 | A1* | 7/2021 | McLoughlin | A61B 5/0022 |
| 2021/0280021 | A1* | 9/2021 | Lewis | H04R 1/10 |
| 2022/0039353 | A1* | 2/2022 | McCreery | A61F 11/145 |
| 2023/0021336 | A1* | 1/2023 | Troxler | G16H 20/70 |

* cited by examiner

ANIMAL ACOUSTIC AUGMENTATION SYSTEMS AND METHODS

CROSS-REFERENCE TO RELATED APPLICATIONS

This application is a continuation of U.S. patent application Ser. No. 17/189,183 filed Mar. 1, 2021 and entitled "ANIMAL ACOUSTIC AUGMENTATION SYSTEMS AND METHODS," which claims priority to and the benefit of U.S. Provisional Patent Application No. 62/982,674 filed Feb. 27, 2020 and entitled "ANIMAL ACOUSTIC AUGMENTATION DEVICE AND METHOD," which are all incorporated herein by reference in their entirety.

TECHNICAL FIELD

The present application generally relates to acoustic devices, and more particularly, for example, to acoustic augmentation systems and methods for animals.

BACKGROUND

Many animals, especially dogs, are well known for their keen sense of hearing, which allows them to detect noises and discriminate certain frequencies from great distances. This sense allows such animals, including pets and service and comfort animals, to avoid perilous situations (cars, trains, etc.), respond to an owner, provide alerts, and respond in a trained way. It is quite common in many dog breeds, however, for hearing capability to degrade to the point where the dog is unable to rely on that critical sense. This creates safety concerns for the dog, or more generally, for the hearing-impaired animal.

Though devoted and reliable pets, dogs in particular are being trained and used more often in a number of critical and meaningful ways. They can be critical surrogate sense animals for people with disabilities such as blindness or deafness. Dogs are also being trained to assist their owners in detecting and responding proactively to certain medical conditions, such as low blood sugar. Further, dogs, as well as other animals, are being trained as companion animals, which provide needed support for individuals with certain physical, mental, and emotional conditions, such as anxiety and obsessive-compulsive disorder (OCD).

In addition to hearing degradation, all pets, including dogs, are beloved, and owners want to keep them protected and cared for. Even with acute hearing, pets tend to wander or explore areas that are unsafe or that they should not explore, which can result in harm to the pet or the pet getting lost. Pets also fear certain noises, such as gun shots, which can distress and panic the animal. Pets also travel with their owners more than ever. When animals cannot ride with the owner in the cabin of the plane, train, bus, etc., they are usually transported in stowage compartments, animal transport areas, or other areas separate from their owner. Such circumstances can stress and create anxiety for the animal.

Accordingly, there is a need in the art for methods and systems to assist animals with degraded hearing in order to keep them relatively safe and, with respect to service and comfort animals, continue to provide the support function that they are trained to do for as long as they can be of service. Moreover, there is a need in the art for methods and systems to provide sounds and familiar acoustics to help make such animals be less anxious in stressful situations.

SUMMARY

Embodiments of the present disclosure are directed to an acoustic augmentation device and related methods for use with animals (generally referred to herein as an animal acoustic augmentor or "AAA"). In some embodiments, the AAA can be an electronic device that is worn, attached, implanted, and/or otherwise configured to be disposed in close proximity to an animal's ear, such as on a collar, a harness, and/or a device secured to the ear or positioned in the ear canal, and to deliver audio and/or enhance acoustic characteristics of the acoustic environment. In some embodiments, the AAA can be integrated with a collar or harness for the animal, for example, and/or may be implanted subdermally in the animal's inner ear or exterior to the ear chamber. Embodiments may also include an acoustic response adapted to activate when an animal attempts to dislodge or remove the AAA. Other embodiments include directing desired acoustic feeds towards or into and/or in close proximity to the ear of the animal, such as prerecorded sounds, livestreamed audio, or real time communications from an owner. Embodiments may also be configured to track the animal so as to provide position information and initiate real time or programmed commands, such as if the animal approaches or goes beyond a designated boundary. Embodiments may also include one or more sensors configured to sense, capture, display, and/or monitor activities and events associated with the animal and/or an environment of the animal. Embodiments may be rechargeable, such as by removing the device to recharge an integrated battery, for example, or by electromagnetic or inductive coupling for wireless charging. Embodiments may also include interface capabilities with remote devices, such as smart phones, computers or laptops, or other personal electronic devices, which can enable live communications, audible selection control, perimeter control and tracking, location capabilities, and/or other features, as described herein.

In one embodiment, an animal acoustic augmentor (AAA) for an animal acoustic augmentation system may include an audio system configured to generate audio proximal and/or for delivery to an ear of an animal and a logic device configured to communicate with and control operation of the audio system. The logic device may be configured to detect an AAA trigger associated with operation of the AAA and/or the audio system and generate an animal-audible trigger response via the audio system of the AAA based, at least in part, on the detected AAA trigger, where the animal-audible trigger response includes a preprogrammed AAA trigger response retrieved from a memory of the AAA and/or a live AAA trigger response based, at least in part, on a control sequence and/or an owner command provided by a personal electronic device associated with the AAA and/or an acoustic environment of the animal.

In another embodiment, a method of operating an AAA for an animal acoustic augmentation system may include detecting an AAA trigger associated with operation of the AAA and/or an audio system of the AAA configured to generate audio proximal and/or for delivery to an ear of an animal and generating an animal-audible trigger response via the audio system of the AAA based, at least in part, on the detected AAA trigger, where the animal-audible trigger response comprises a preprogrammed AAA trigger response retrieved from a memory of the AAA and/or a live AAA trigger response based, at least in part, on a control sequence and/or an owner command provided by a personal electronic device associated with the AAA and/or an acoustic environment of the animal.

The scope of the present disclosure is defined by the claims, which are incorporated into this section by reference. A more complete understanding of embodiments of the present disclosure will be afforded to those skilled in the art, as well as a realization of additional advantages thereof, by a consideration of the following detailed description of one or more embodiments. Reference will be made to the appended sheets of drawings that will first be described briefly.

Figure 1:
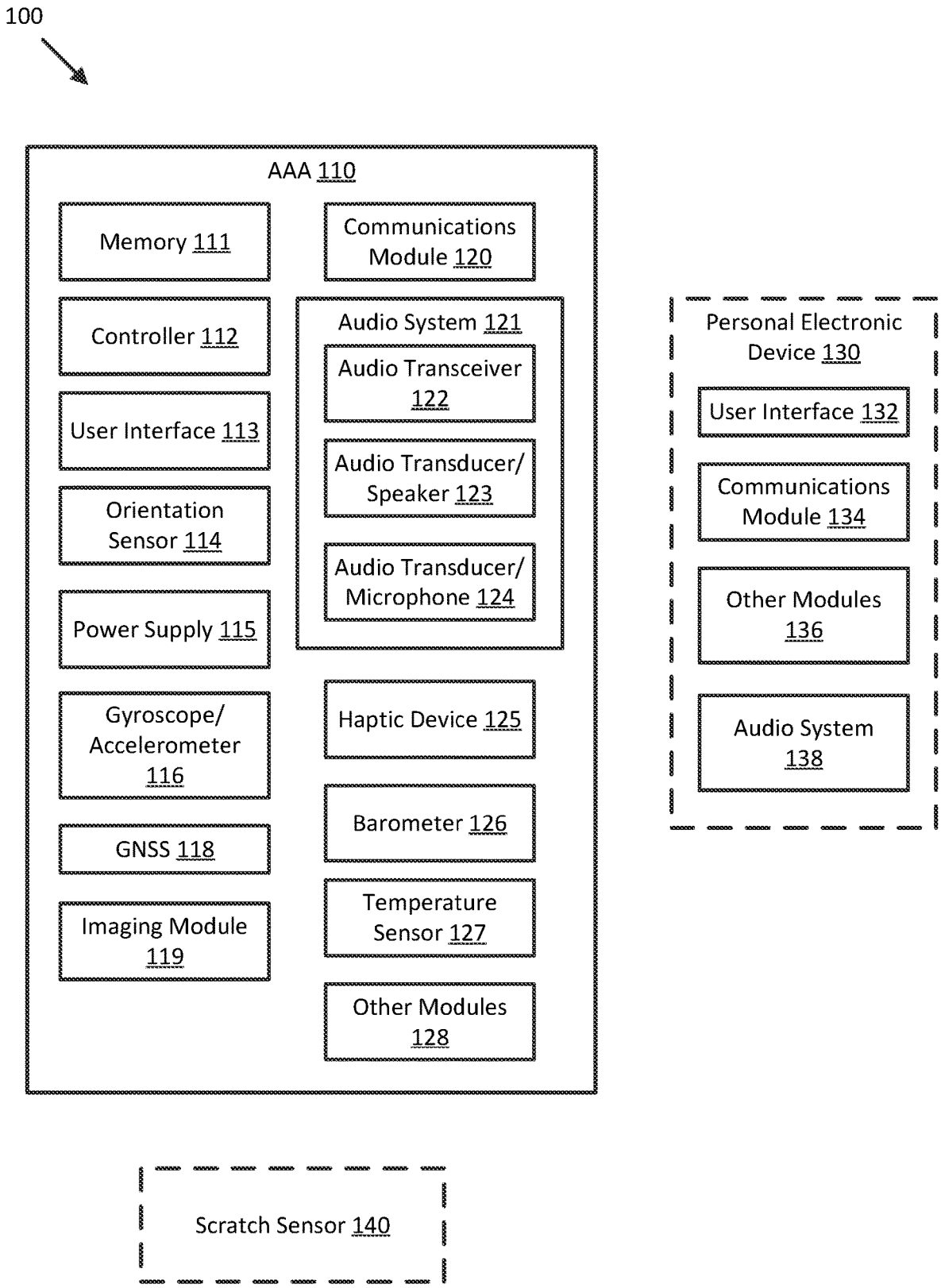
FIG. 1 illustrates a block diagram of an animal acoustic augmentation system including an animal acoustic augmentor (AAA), in accordance with an embodiment of the disclosure.

Embodiments of the present disclosure and their advantages are best understood by referring to the detailed description that follows. Unless otherwise noted, like reference numerals denote like elements throughout the attached drawings and the written description, and thus, descriptions thereof will not be repeated. In the drawings, the relative sizes of elements, layers, and regions may be exaggerated for clarity.

DETAILED DESCRIPTION

Embodiments of the present disclosure include an animal acoustic augmentation system (AAA) configured to help animals, such as dogs, hear better when they are suffering from degraded hearing from old age or health induced issues. For example, an AAA may be coupled in proximity to an animal's ear and/or ear canal and be electronically configured to: deliver and/or enhance sounds from the environment, which can ensure the animal does not wander into a perilous situation, such as the path of a car or train; help the animal hear and appropriately respond to an owner's commands; direct programed sounds into the ear and/or ear canal of an animal to help calm, distress, distract, and/or train the animal—such preprogrammed sounds may include, for example, sounds of the owner's voice to sooth the animal, music or white noise that can distract the animal from anxious situations or loud noises that would normally stress the animal, or specific sounds, commands, or frequencies that may be used to train or control the animal (for example if it wanders outside a specific area); wirelessly interface with mobile devices which can allow for a remote person to issue commands, create soothing sounds, activate a training aid (e.g. a vibration), or otherwise direct live and/or preprogrammed communications to the animal over distances that are beyond reliably audible reach; and/or establish a telemetry communication link (radio frequency (RF), radio, cellular, satellite GPS, etc.) between the animal and a mobile device, such that the animal can be tracked at any given time, the position of the animal relative to a desired boundary or location may be monitored, audible commands or haptic responses may be issued if the animal goes outside of a designated area, and/or the owner of the animal may be alerted to enable prompt location.

An AAA may be configured to couple and/or provide audio to the animal's ear, be carried by, integrated with, and/or clip to a collar, harness, and/or other wearable element in a variety of ways. For ear coupled configurations, the AAA may be clipped and/or otherwise coupled directly onto or into the ear and have an acoustic generator that directs sounds, frequencies, and/or energy (e.g., vibrations), to the animal's ear and/or ear canal. The AAA may be attached to the inner ear, outer ear, or an area proximal to the ear in a variety of ways (e.g., via a collar, strap, adhesive, and/or a magnetic and/or mechanical coupling). The AAA may also be wholly or partially subdermally implanted inside or outside the ear of the animal. In various embodiments, the AAA may be powered using rechargeable and/or removable/replaceable long-life batteries. The AAA's batteries can be recharged in a number of ways. For example, charging can be inductively induced via an inductive charging mat disposed in a bed for the animal or via an inductive battery coupling from a collar of the animal, such that the battery inductively charges while the animal sleeps. In other embodiments, an electrical charging block may be electromechanically coupled to the AAA for brief periods to charge the AAA.

An AAA (particularly ear-coupled embodiments) will undoubtedly present an irritant to the animal. Methods for training the animal to avoid scratching the AAA or attempting to remove the AAA are disclosed. In one embodiment, a device (e.g., a scratch sensor) may be coupled to a leg of the animal that is configured to cause the AAA or the scratch sensor to issue an alert, a command, a haptic response, and/or other sensory discharge when the scratch sensor is put in proximity to the AAA configured to discourage and train the animal to avoid trying to dislodge the device. The AAA or the scratch sensor may include gyros or other movement sensing devices that may be configured to detect an undesirable engagement with the AAA or the scratch sensor, thus causing the AAA or the scratch sensor to issue a similar alert, command, or haptic response to dissuade continued device disruption.

An AAA may also include a variety of sensors that can provide sensor information to the pet owner in real time or be recorded (locally or cloud based) for later analysis. For example, an AAA may include a camera that can capture still imagery and/or video of the environment around the animal. This can be particularly useful for elderly pet owners who may be prone to health or age-related issues. Because the animal will likely be close to the owner or can be trained to approach the owner or other individual via a remotely issued command, a loved one or other caregiver can use an animal outfitted with an AAA to check on an elderly parent and/or a child periodically, on demand, and/or automatically, as described herein.

Embodiments described herein are not intended to limit the scope of the invention. Further, while certain figures include a depiction of a dog, embodiments of the AAA may be used on other animals, as described herein. For example, in one embodiment, an AAA may be coupled to a dog and adapted to provide acoustic augmentation. As illustrated herein, the AAA may be coupled directly to a dog's ear. The AAA may be coupled to the outside of the ear, under the ear, in the otic region of the ear, or any other area on the dog that is proximal to the ear (e.g., via a collar or harness) such that acoustic augmentation can be directed to and/or towards the dog's ear. The AAA may have a speaker, or as illustrated, a flexible acoustic diverter may be positioned deeper into the otic canal of the dog.

In various embodiments, an AAA may be an electronic device adapted to enhance sounds, generate sounds, generate haptic signals, or otherwise create or transmit acoustics and frequencies to and/or towards the dog's ear. In one embodiment, the AAA may include a power source, which can be a replaceable or rechargeable battery. For rechargeable batteries, the AAA may be removed from the dog and recharged overnight. The batteries may also be configured to be inductively charged by an inductive charging block. The inductive charger can be positioned on, for example, a collar to ensure the AAA battery is charged. Other wired and/or wireless (inductive) charging forms may be used as well, such as placing a charging mat in the dog's bed.

The AAA may include an amplifier and a volume control. It may also have an onboard storage and processor to store sounds, such as owner commands and white noise, as well as other training aids, such as high frequency sounds, and vibrations (e.g., vibration patterns). The AAA may include a haptic sensor or device that can generate vibrations, a gyro, and other electronic components, as described herein. All or any combination of the components may be packaged in a waterproof enclosure to help prevent the AAA from failing due to water ingress or other environmental impacts.

An AAA may be coupled to a dog and/or proximal a dog's ear in a variety of ways. For example, a clip may be attached to the AAA and configured to clip the device to the dog's ear; either on the inside or outside of the ear. The device may be magnetized, such that a magnet can be positioned on the opposite side of the ear, thus securing the device to the dog's ear. Rare earth magnets are viable options for ensuring a substantial coupling. The AAA may also be coupled to a collar, where one or more speakers can be positioned (fixed or adjustable) so that audio can be reliably directed towards the animal's ear. Because disposing an AAA at the ear of the dog may irritate the dog, an AAA may be implemented according to methods and devices for training the dog to not scratch or attempt to rub the device away from its ear. In one embodiment, the AAA may be configured with a sensor adapted to sense the position of a dog's paw, for example, and initiate a vibration or other haptic response, a relatively high-pitched or ultrasonic sound, or a prerecorded owner command to dissuade the dog from scratching at the AAA. One or more such sensors, in the form of sensor bands, straps, or harnesses, may be positioned on a leg or legs of the dog. In another embodiment, the AAA may include a gyro and be configured to generate a dissuading response if the dog attempts to scratch its head against a floor, wall, or other obstacle. Other proximity sensors may be used to provide a response.

In some embodiments, an AAA may be preprogramed with soothing or comforting sounds or commands that may be directed towards and/or into the dog's ear on command, at preprogramed intervals, or under predetermined circumstances. For example, the device may include white noise or music that can be initiated to drown out other detected sounds that tend to stress the dog (e.g., gun shots, fireworks, airplanes, etc.). Sounds and/or the owner's voice may be played when the dog is in environments that create anxiety for the dog, such as when being transported in the cargo hold of an airplane or when the dog is in a kennel while its owner is on vacation.

In various embodiments, an AAA may include a transceiver or communications module that can enable communications between the dog and a personal electronic device (e.g., a computer, laptop, smart phone, smart watch, digital assistant, and/or other smart device) in possession of the dog's owner. Such smart device may be coupled to or form a wireless communication link with the transceiver in the AAA worn by the animal via a number of telemetry and/or other wireless interfaces and/or protocols, including, but not limited to cellular, radio frequency, wide area networks, Wi-Fi, Bluetooth, Zigbee, Xbee, NFC, RFID, proprietary, and others. With a wireless communication interface, the owner can issue commands to the dog from a distance that is beyond typical audible reach (e.g., across a large park, or while traveling). The owner can talk to the dog while the owner is on vacation, for example, or from the main cabin of an airplane while the dog is in the pressurized baggage compartment. The owner can also control automated sounds that are directed to the dog, such as different music, white noise or soothing frequencies generated by the AAA. With various mobile links, such as a cellular communication module in the AAA, the location of the dog can be established and monitored/tracked (e.g., using cell tower location information), for example, so as to ensure the owner does not lose the dog. The AAA may include a GPS module configured to further refine the location tracking of the dog. In one embodiment, an owner may establish a geographic boundary the dog should stay within, such as through use of geofencing or a virtual trip wire. If the dog wanders outside the established boundary or line, the AAA may be configured to alert the owner on a smart device, and the owner can use the smart device to control the AAA to issue a command or send a haptic signal to the dog. The AAA can also be configured to automatically initiate a command, haptic signal, or other sound to alert the animal that it has gone beyond the established perimeter and train and/or control the animal to retreat back within the perimeter.

In some embodiments, the AAA may be carried on or clipped to or integrated with a collar or harness for the animal. In such embodiments, the collar may include a speaker to deliver audible sounds corresponding to audio data to the animal wearing the collar. Because certain environments may not allow or appreciate hearing audible sounds generated by the AAA and intended solely for the animal wearing the device, an acoustic channel may be coupled between the collar and the animal's ear to direct the audible sounds from the AAA to the animal's ear. This may also be helpful for animals who have degraded hearing. In various embodiments, a speaker or other audio projection device may be coupled to the animal's ear and wirelessly connected to a collar or harness-based AAA.

In another embodiment, the AAA may include a camera or other sensor adapted to capture imagery and/or video of the environment around the animal. For example, a collar carried AAA may include a visible spectrum camera that can enable a remote user to see the area around the animal in real time. The AAA may also be configured to record video or transmit such imagery to a remote hosted server for later viewing. In one embodiment, the camera can be selectively activated by a user who has access to the AAA via a mobile device. This can enable the user to selectively view the environment around the animal, for example, such as when a loved one would like to see if the animal owner is incapacitated or in distress, for instance, or in search and rescue operations. In some embodiments, the AAA may include sensors such as a gyro and/or an accelerometer. Such sensors can help track the animal's activity (such as running, eating, sleeping) and provide such data to a personal electronic device of the owner. The owner can then communicate to the animal in real time, or the AAA may initiate a preprogrammed audio command, if the sensors detect undesirable activity, such as prolonged eating, or lack of activity, to encourage the animal to change its behavior.

In various embodiments, an AAA can be adapted to enable two-way communications with the animal or persons in close proximity to the animal. For example: should the animal get lost, the owner/user or a person finding the animal can initiate communications in order to coordinate directly/verbally as needed. The two-way communications can be selectively enabled by the owner depending on the nature of the situation. In one embodiment, the AAA may include an alert feature (e.g., a button on a collar-based AAA) that a third party can activate in order to alert the owner/user of the AAA on their mobile device in order to initiate two-way communications, such as when a stranger or dogcatcher finds the animal but cannot immediately find the owner.

Various features and aspects of the embodiments described herein may be used individually or jointly. Further, although the embodiments have been described in the context of its implementation in a particular environment, and for particular applications (e.g., providing acoustic augmentation to dogs and other pets, service animals, and/or comfort animals), the usefulness of the embodiments is not limited thereto, and embodiments can be used beneficially in any number of environments and implementations including but not limited to any other applications where they would be useful to enhance hearing, communication, and training of such animals.

An animal acoustic augmentor (AAA) of an animal acoustic augmentation system generally detects an AAA trigger associated with operation of the AAA and/or an audio system of the AAA and then generates a corresponding animal-audible trigger response, as described herein. For example, where the audio system of the AAA includes a microphone, the AAA trigger may include a sound uttered by the animal, such as a bark, or an environmental sound that might cause stress in the animal, such as fireworks, gunshots, car horns, and/or other relatively loud sounds. In such embodiments, the AAA may be configured to generate an appropriate animal-audible trigger response, such as an audible owner command for the animal to be quiet, for example, or one or more destressing sounds, such as an owners voice, white noise, and/or low tone/frequency music or audible frequencies. Such animal-audible trigger responses may be preprogrammed sounds stored in a local memory and selected for playback as appropriate for the circumstances of the AAA trigger and/or an operational state of the AAA, for example, or may be live sounds captured by a microphone and then played back into the animal's ear.

More generally, the AAA trigger may include a variety of animal activities (e.g., uttered sounds, positioning, body motion) and/or associated environmental conditions (e.g., environmental sounds, ambient temperatures and/or pressure changes, ambient lighting changes) detected via sensor data generated by one or more environmental sensors of the AAA, and the appropriate animal-audible trigger response may include owner commands to control the behavior of the animal appropriate to the context of the AAA trigger, for example, or sounds generated according to an operational state of the AAA. For example, in a particular embodiment, the AAA may be configured to provide hearing enhancement for an animal with damaged or failing hearing, where the AAA trigger is ambient sound above a minimum threshold volume level (as measured at the AAA) and the animal-audible trigger response is an amplified version of the ambient sound delivered to the animal's ear.

In alternative and/or supplemental embodiments, detecting an AAA trigger may include the AAA receiving a control signal corresponding to user selection of a remote-control sequence, such as a remote-control sequence to issue a preprogrammed owner command, and the generating the appropriate animal-audible trigger response would include generating the preprogrammed owner command. In other embodiments, such remote-control sequence may be configured to control the AAA to playback live audio captured by a remote device and transmitted to the AAA, such as an owner ordering a pet to stay or return without having to yell across a large park or field. In addition to animal-audible trigger responses, the AAA may be configured to generate haptic device responses and/or transmit sensor data (e.g., captured audio data, image data, position data, motion data, and/or other sensor data) appropriate to the context of the AAA trigger to a personal electronic device, as described herein.

FIG. 1 illustrates a block diagram of an animal acoustic augmentation system 100 including an animal acoustic augmentor (AAA) 110, in accordance with an embodiment of the disclosure. In various embodiments, AAA 110 may be fastened, secured, and/or implanted in to an animal and positioned to monitor the environment about the animal and/or generate and deliver electronically generated or played back sounds or audio to or towards/in proximity to an ear of the animal in order to control or modify/alter the behavior and/or mood of the animal, such as calming or soothing the animal. Such environmental monitoring may include the capture of environmental sounds and/or imagery about the animal, for example, and sounds may include a variety of synthetic, recorded, or live sounds designed or selected to facilitate training, soothing, commanding, and/or otherwise modifying the behavior of the animal substantially in real time. In some embodiments, a user or owner may use personal electronic device 130 (e.g., a tablet, laptop, desktop computer, or smart phone, or other personal electronic device including a user interface 132 implemented, at least in part, by a display) to provide live control of the animal via AAA 110. In other embodiments, a user or owner may use personal electronic device 130 to record preprogrammed sounds, to configure AAA 110 for a particular type of operation (e.g., hearing enhancement, automated behavior reinforcement training, automated destressing), or to passively monitor positioning, motion, and/or the environment about the animal. In particular embodiments, system 100 may include optional scratch sensor 140, which may act as a part of an active or passive proximity sensor configured to detect when an animal may be attempting to remove AAA 110 so that AAA 110 can issue audible or haptic responses to countermand the animal before it dislodges or removes AAA 110.

In the embodiment shown in FIG. 1, system 100 includes AAA 110, optional personal electronic device 130, and optional scratch sensor 140. In general, AAA 110 may be implemented as a collar, a harness, and/or an ear coupled (e.g., clipped or implanted) wirelessly connected audio device configured to deliver electronically generated or played back sounds into or towards an ear of an animal. As shown in FIG. 1, AAA 110 may include one or more of a memory 111, a controller 112, an orientation sensor 114, a power supply 115, a gyroscope/accelerometer 116, a global navigation satellite system (GNSS) 118, an imaging module 119, a communications module 120, an audio system 121 (e.g., including an audio transceiver 122 and one or more audio transducers 123-124), a haptic device 125, various environmental sensors (a barometer 125, a temperature sensor 127), and other modules 128. Imaging module 140 may be configured to capture visible spectrum and/or other imagery as selected and/or framed by operation of AAA 110 and/or personal electronic device 130, for example, and/or associated with maneuvering of AAA 110, as described herein. In general, operation of AAA 110 may be substantially autonomous and/or partially or completely controlled by optional personal electronic device 130, which may include one or more of a user interface 132, a communications module 134, and other modules 136, as shown.

Controller 112 may be implemented as any appropriate logic device (e.g., processing device, microcontroller, processor, application specific integrated circuit (ASIC), field programmable gate array (FPGA), memory storage device, memory reader, or other device or combinations of devices) that may be adapted to execute, store, and/or receive appropriate instructions, such as software instructions implementing a control loop for controlling various operations of AAA 110 and/or other elements of system 100, for example. Such software instructions may also implement methods for processing audio and/or other sensor signals, determining sensor information, providing user feedback (e.g., through user interfaces 113 and/or 132), querying devices for operational parameters, selecting operational parameters for devices, or performing any of the various operations described herein (e.g., operations performed by logic devices of various devices of system 100).

In addition, a non-transitory medium, such as memory 111, may be provided for storing machine readable instructions for loading into and execution by controller 112. In these and other embodiments, controller 112 may be implemented with other components where appropriate, such as volatile memory, non-volatile memory, one or more interfaces, and/or various analog and/or digital components for interfacing with devices of system 100. For example, controller 112 may be adapted to store recorded audio, received audio data, sensor signals, sensor information, calibration parameters, sets of calibration points, and/or other operational parameters, over time, for example, and provide such stored data to a user via user interface 132. In some embodiments, controller 112 may be integrated with one or more other elements of AAA 110, for example, or distributed as multiple logic devices within AAA 110, personal electronic device 130, and/or scratch sensor 140. In various embodiments, memory 111 may be implemented as one or more machine readable mediums and/or logic devices configured to store software instructions, sensor signals, control signals, operational parameters, calibration parameters, audio recordings, telemetry data, and/or other data facilitating operation of system 100, for example, and provide it to various elements of system 100. Memory 111 may also be implemented, at least in part, as removable memory, such as a secure digital memory card, for example, including an interface for such memory.

In some embodiments, controller 112 may be configured to substantially continuously monitor and/or store the status of and/or sensor data provided by one or more elements of AAA 110, scratch sensor 140, and/or personal electronic device 130, such as the position and/or orientation of AAA 110, scratch sensor 140, and/or personal electronic device 130, for example, and the status of a communication link established between AAA 110, scratch sensor 140, and/or personal electronic device 130. Such communication links may be established and then used to transmit data between elements of system 100 substantially continuously throughout operation of system 100, where such data includes various types of sensor data, control parameters, and/or other data (e.g., including live audio and/or image data).

User interface 113 of AAA 110 may be implemented as one or more of a display, an LED, a button, and/or any other device capable of accepting user input and/or providing feedback to a user. In various embodiments, user interface 113 may be adapted to provide user input (e.g., as a type of signal and/or sensor information) to controller 112 to facilitate various processes and/or methods described herein, including turning AAA 110 on or off, checking a power status of AAA 110, establishing a wireless communication link between AAA 110 and personal electronic device 130 and/or scratch sensor 140, and/or pairing scratch sensor 140 with AAA 110. In other embodiments, user interface 113 may be adapted to accept user input modifying a control loop parameter of controller 112, for example. Such control signals may be provided to controller 112, which may then control AAA 110 and/or elements of AAA 110 accordingly.

Orientation sensor 114 may be implemented as one or more of a compass, float, accelerometer, and/or other device capable of measuring an orientation of AAA 110 (e.g., magnitude and direction of roll, pitch, and/or yaw, relative to one or more reference orientations such as gravity and/or Magnetic North) and providing such measurements as sensor signals and/or data that may be communicated to various devices of system 100. Gyroscope/accelerometer 116 may be implemented as one or more electronic sextants, semiconductor devices, integrated chips, accelerometer sensors, accelerometer sensor systems, or other devices capable of measuring angular velocities/accelerations and/or linear accelerations (e.g., direction and magnitude) of AAA 110 and/or other elements of system 100 and providing such measurements as sensor signals and/or data that may be communicated to other devices of system 100 (e.g., user interface 132, controller 112).

Power supply 115 may be implemented as one or more batteries (e.g., replaceable and/or rechargeable batteries), capacitors, or other electrical power storage devices, for example, and may in some embodiments include one or more solar and/or kinetic electrical power generating devices. In particular embodiments, power supply 115 may include one or more of a wired and/or wireless charging interface, for example, which may be used to charge an electrical power storage device of power supply 115 while AAA 110 is worn by an animal or when AAA 110 is removed from the animal. In related embodiments, such wired and/or wireless charging interfaces may be used to support one or more communication techniques between elements of system 100.

GNSS 118 may be implemented according to any global navigation satellite system, including a GPS, GLONASS, and/or Galileo based receiver and/or other device capable of determining absolute and/or relative position of AAA 110 (e.g., or an element of AAA 110) based on wireless signals received from space-born and/or terrestrial sources (e.g., eLoran, and/or other at least partially terrestrial systems), for example, and capable of providing such measurements as sensor signals and/or data (e.g., coordinates) that may be communicated to various devices of system 100. In some embodiments, GNSS 118 may include an altimeter, for example, or may be used to provide an absolute altitude.

Imaging module 119 may be implemented as a camera or other imaging device, which may include an array of detector elements, such as visible spectrum detector elements, that can be arranged in a focal plane array. In various embodiments, imaging module 119 may include one or more logic devices (e.g., similar to controller 112) that can be configured to process imagery captured by detector elements of imaging module 119 before providing the imagery to memory 111 or communications module 120. More generally, imaging module 119 may be configured to perform any of the operations or methods described herein, at least in part, or in combination with controller 112 and/or user interface 113.

Communications module 120 may be implemented as any wired and/or wireless communications module configured to transmit and receive analog and/or digital signals between elements of system 100. In other embodiments, communications module 120 may be configured to receive audio, images (e.g., still images or video images), and/or other sensor information from audio system 121 and/or imaging module 119 and relay the sensor data to controller 112 and/or personal electronic device 130. In various embodiments, communications module 120 may be configured to support spread spectrum transmissions, for example, and/or multiple simultaneous communications channels between elements of system 100. Wireless communication links may include one or more analog and/or digital radio communication links, such as cellular, WiFi, Bluetooth, NFC, and others, as described herein, and may be direct communication links established between elements of system 100, for example, or may be relayed through one or more wired and/or wireless networks, which may include wide area networks, such as the Internet.

In some embodiments, communications module 120 may be configured to monitor the status of a communication link established between AAA 110 and personal electronic device 130. Such status information may be provided to controller 112, for example, or transmitted to other elements of system 100 for monitoring, storage, or further processing, as described herein. Communication links established by communication module 120 may be configured to transmit data between elements of system 100 substantially continuously throughout operation of system 100, where such data includes various types of sensor data, control parameters, and/or other data, as described herein.

Audio system 121 may be implemented by any combination of audio and/or ultrasonic amplifiers, transducers, and/or other audio electronics configured to capture and/or generate audio proximal and/or for delivery to an ear of an animal. In the embodiment shown in FIG. 1, audio system 121 includes audio transceiver 122 and one or more audio transducers 123-124 (e.g., one or more speakers and/or microphones). In various embodiments, audio transceiver 122 may include an amplifier, an analog to digital converter, and/or a digital to analog converter configured to receive digital audio data from controller 112 and generate corresponding analog audio signals configured to produce audible playback of the digital audio when provided to speaker 123, for example, and/or to capture environmental audio by receiving analog audio signals from microphone 124 and converting the analog audio signals to digital audio, which may then be provided to controller 112 (e.g., for storage, processing, and/or transmission to personal electronic device 130). More generally, audio transceiver 122 and audio transducers 123-124 of audio system 121 may be configured to detect AAA triggers and/or generate animal-audible trigger responses, as described herein.

In some embodiments, AAA 110 may include one or more haptic devices 125, which may be implemented by any electronic or electrical device or combination of devices configured to generate haptic device responses (e.g., vibrations, mild electrical shocks, temperature gradients, and/or other haptic feedback) according to control signals generated by controller 112. AAA 110 may also include various environmental sensors, such as barometer 125 and/or temperature sensor 127, which may be configured to generate corresponding ambient pressure data and/or ambient temperature data, for example, and provide it to controller 112. Such ambient environmental sensor data may be monitored to assess a condition of an animal and/or the environment about the animal, as described herein.

Other modules 128 may include other and/or additional sensors, actuators, communications modules/nodes, and/or user interface devices, for example, and may be used to provide additional environmental information related to operation of AAA 110, for example. In some embodiments, other modules 128 may include a humidity sensor, a wind and/or water temperature sensor, a proximity sensor, and/or other environmental sensors providing measurements and/or other sensor signals that can be displayed to a user and/or used by other devices of system 100 (e.g., controller 112, personal electronic device 130) to provide operational control of AAA 110 and/or system 100. In some embodiments, other modules 128 may include one or more buckles, harness, body straps, adhesives, permanent magnets, clamps, and/or other mechanical elements configured to secure AAA 110 to an animal and/or position at least speaker 123 proximate to an ear or ear canal of the animal, as described herein. In one embodiment, other modules 128 may include a button or other user interface device of AAA 110 (e.g., a "contact my owner" button) configured to cause controller 112 to generate a user alert that is transmitted to personal electronic device 130 to alert the user/owner that a third party is in possession of the animal and requires the attention of the user/owner. Such alert may include the time of the alert, a position of AAA 110 (e.g., via GNSS 118), and/or other telemetry data provided by AAA 110. In various embodiments, depressing such button (e.g., by a third party) may generate the alert, may enable audio system 121 for two-way audio communications, and/or enable imaging module 119 to capture imagery and/or video of the environment about the animal, each of which may be automatically transmitted to personal electronic device 130, as described herein.

As noted herein, personal electronic device 130 may be a smart phone, a tablet, a laptop, a desktop computer, a digital assistant (e.g., typically configured to operate through verbal commands), and/or other personal electronic device configurable to perform the processes described herein. User interface 132 of personal electronic device 130 may be implemented as one or more of a display, a touch screen, a keyboard, a mouse, a joystick, a knob, and/or any other device capable of accepting user input and/or providing feedback to a user. In various embodiments, user interface 132 may be adapted to provide user input (e.g., as a type of signal and/or sensor information transmitted by communications module 134 of personal electronic device 130) to other devices of system 100, such as controller 112 of AAA 110. User interface 132 may also be implemented with one or more logic devices (e.g., similar to controller 112) that may be adapted to store and/or execute instructions, such as software instructions, implementing any of the various processes and/or methods described herein. For example, user interface 132 may be adapted to form communication links, transmit and/or receive communications (e.g., audio, imagery, and/or other sensor signals, control signals, sensor information, user input, and/or other information), for example, or to perform various other processes and/or methods described herein.

In one embodiment, user interface 132 may be adapted to display a time series of various sensor information and/or other parameters as part of or overlaid on a graph or map, which may be referenced to a position and/or orientation of AAA 110 and/or other elements of system 100. For example, user interface 132 may be adapted to display a time series of positions, headings, and/or orientations of AAA 110 and/or other elements of system 100 overlaid on a geographical map, which may include one or more graphs indicating a corresponding time series of sensor information, and/or other sensor and/or control signals.

In some embodiments, user interface 132 may be adapted to accept user input including a user command for an element of AAA 110, for example, and to generate control signals to cause AAA 110 to operate accordingly. In other embodiments, user interface 132 may be adapted to accept user input modifying a control loop parameter of controller 112, for example. Such control signals may be transmitted to controller 112 (e.g., using communications modules 134 and 120), which may then control AAA 110 and/or elements of AAA 110 accordingly.

Communications module 134 may be implemented as any wired and/or wireless communications module configured to transmit and receive analog and/or digital signals between elements of system 100. For example, communications module 134 may be configured to receive sensor data (e.g., audio data, still images or video images, or other sensor data) from AAA 110. In some embodiments, communications module 134 may be configured to support spread spectrum transmissions, for example, and/or multiple simultaneous communications channels between elements of system 100. In various embodiments, communications module 134 may be configured to monitor the status of a communication link established between personal electronic device 130 and AAA 110 (e.g., including packet loss of transmitted and received data between elements of system 100, such as with digital communication links), as described herein. Such status information may be provided to user interface 132, for example, or transmitted to other elements of system 100 for monitoring, storage, or further processing, as described herein. Audio system 138 may be implemented similarly to audio system 121, for example, and be configured to capture user provided audio and transmit it as digital audio to AAA 110, for example, and/or receive digital audio data from AAA 110 and generate corresponding remote audio at personal electronic device 130 (e.g., via communications module 120 and 134).

Other modules 136 of personal electronic device 130 may include other and/or additional sensors, audio systems, audio transducers, communications modules/nodes, and/or user interface devices used to provide audio data and/or additional environmental information associated with personal electronic device 130, for example. In some embodiments, other modules 136 may include a visible spectrum camera, a GNSS, and/or other environmental sensors providing measurements and/or other sensor signals that can be displayed to a user and/or used by other devices of system 100 (e.g., controller 112) to provide operational control of AAA 110 and/or system 100.

Optional scratch sensor 140 may be implemented as a wireless proximity beacon or transmitter configured to emit a signal, such as a radio frequency (RF) signal or a magnetic field, that may be sensed by AAA 110 (e.g., by orientation sensor 114 and/or communications module 120) and used to determine if scratch sensor 140 is within a predefined range of AAA 110. For example, in some embodiments, scratch sensor 140 may be implemented as a paw strap configured to be secured proximate a paw of an animal, where the paw strap includes a magnet configured to generate a magnetic field detectable by AAA 110 (e.g., by orientation sensor 114 and/or a magnetometer—other modules 128—of AAA 110) when scratch sensor 140 is within a predefined minimum safety range (e.g., 2-4 inches) of AAA 110. AAA 110 may be configured to generate an audible or haptic trigger response to such detected proximity trigger that is configured to stop the animal from scratching at AAA 110. In other embodiments, such paw strap may include an RFID device and/or a communications module similar to communications module 120, and AAA 110 may be configured to detect when scratch sensor 140 is within the predefined minimum safety range (e.g., 2-4 inches) of AAA 110 based on RF signals generated by the RFID or communications module of scratch sensor 140. In further embodiments, scratch sensor 140 may include embodiments of controller 112, power supply 115, gyroscope/accelerometer 116, and communications module 120 and be configured to detect motion of the animal paw indicative of an attempt to scratch at AAA 110 and transmit a control signal indicating the detected motion to AAA 110, which may then generate an appropriate scratch dissuading audible sound and/or haptic trigger response, as described herein.

In general, each of the elements of system 100 may be implemented with any appropriate logic device (e.g., processing device, microcontroller, processor, application specific integrated circuit (ASIC), field programmable gate array (FPGA), memory storage device, memory reader, or other device or combinations of devices) that may be adapted to execute, store, and/or receive appropriate instructions, such as software instructions implementing a method for providing sensor data and/or imagery, for example, or for transmitting and/or receiving communications, such as sensor signals, sensor information, and/or control signals, between one or more devices of system 100.

In addition, one or more non-transitory mediums may be provided for storing machine readable instructions for loading into and execution by any logic device implemented with one or more of the devices of system 100. In these and other embodiments, the logic devices may be implemented with other components where appropriate, such as volatile memory, non-volatile memory, and/or one or more interfaces (e.g., inter-integrated circuit (I2C) interfaces, mobile industry processor interfaces (MIPI), joint test action group (JTAG) interfaces (e.g., IEEE 1149.1 standard test access port and boundary-scan architecture), and/or other interfaces, such as an interface for one or more antennas, or an interface for a particular type of sensor).

Sensor signals, control signals, and other signals may be communicated among elements of system 100 using a variety of wired and/or wireless communication techniques, including voltage signaling, Ethernet, WiFi, Bluetooth, Zigbee, Xbee, NFC, RFID, Micronet, or other medium and/or short range wired and/or wireless networking protocols and/or implementations, for example. In such embodiments, each element of system 100 may include one or more modules supporting wired, wireless, and/or a combination of wired and wireless communication techniques. In some embodiments, various elements or portions of elements of system 100 may be integrated with each other, for example, or may be integrated onto a single and/or flexible printed circuit board (PCB) to reduce system complexity, manufacturing costs, power requirements, coordinate frame errors, and/or timing errors between the various sensor measurements. Each element of system 100 may include one or more batteries, capacitors, or other electrical power storage devices, for example, and may include one or more kinetic electrical power generating devices. In some embodiments, one or more of the devices may be powered by a power source for AAA 110, using one or more power leads. Such power leads may also be used to support one or more communication techniques between elements of system 100.

Figure 2:
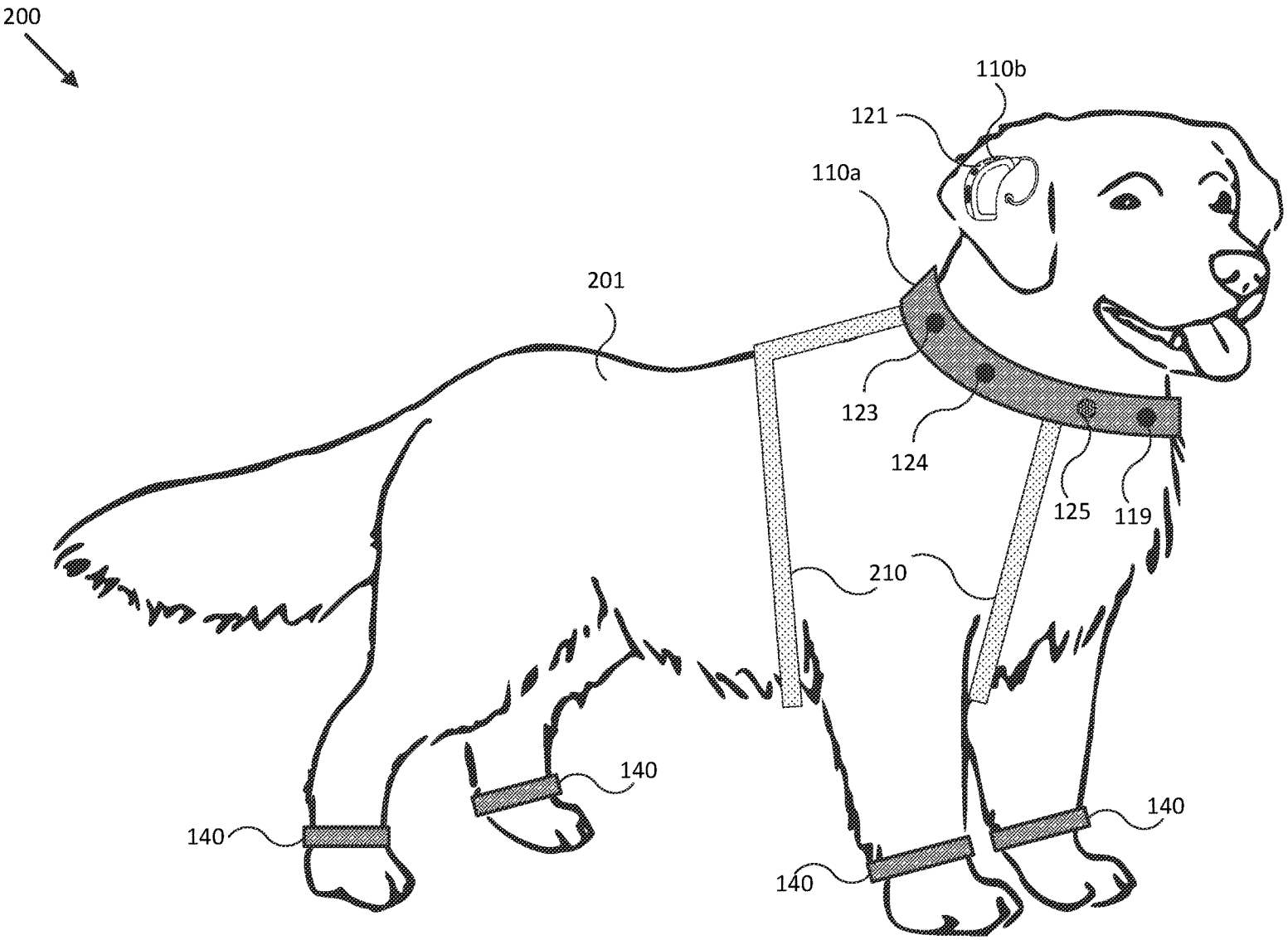
FIG. 2 illustrates a diagram of an animal acoustic augmentation system including an AAA worn by an animal, in accordance with an embodiment of the disclosure.

FIG. 2 illustrates a diagram of an animal acoustic augmentation system 200 including one or more AAAs 110*a*, 110*b* worn by an animal 201, in accordance with an embodiment of the disclosure. In the embodiment shown in FIG. 2, system 200 includes animal 201 wearing AAA 110*a* implemented as a collar and/or AAA 110*b* implemented as an ear mounted and/or fully or partially implanted or embedded device, for example, and one or more scratch sensors 140 each implemented as paw straps secured to the legs of animal 201 proximate paws of animal 201. In some embodiments, AAA 110*a* may be implemented as a harness and include body straps 210, as shown. In various embodiments, AAA 110*a* may include audio transducer 123 (e.g., a speaker), audio transducer 124 (e.g., a microphone), haptic device 125, and/or imaging module 119 disposed along the outside (e.g., speaker 123, microphone 124, imaging module 119) or inside (e.g., haptic device 125) of collar 110*a*, as shown. Each of AAAs 110*a* and 110*b* may be implemented with an embodiment of audio system 121, as shown. In some embodiments, AAA 110*b* may include one or more permanent magnets (e.g., other modules 128) configured to secure AAA 110*b* to and/or substantially within the ear of animal 201. In other embodiments, AAA 110*b* may be surgically subdermally embedded within the ear of animal 201. Although animal 201 is depicted as a dog in FIG. 2, the various elements of system 200 may be size and/or fit adjusted to couple to the body and/or ear(s) of other animals, such as cats, horses, rodents, and/or other four-footed animals that can respond to acoustic commands and/or other animal-audible trigger responses, as described herein.

Figure 3:
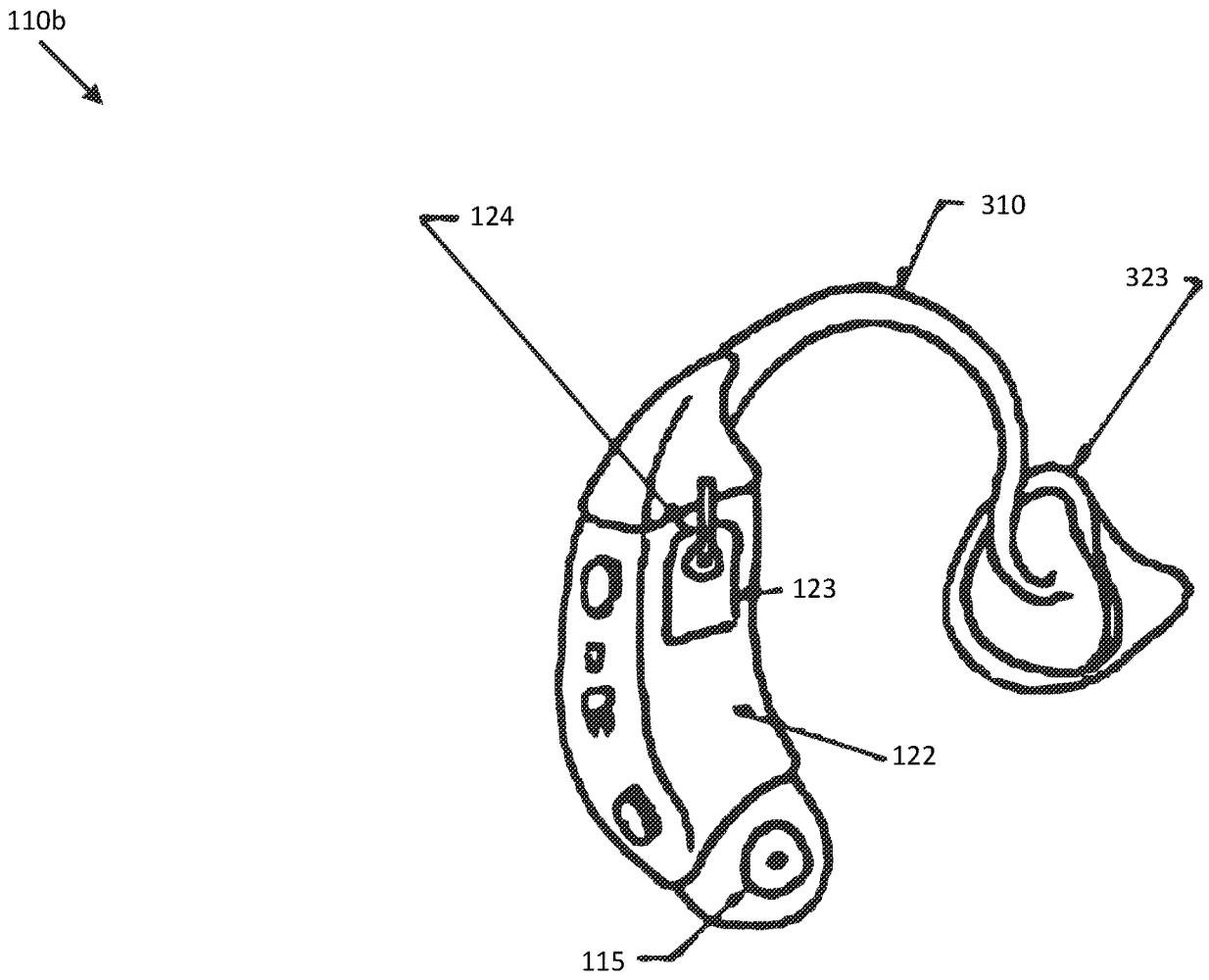
FIG. 3 illustrates a diagram of an AAA configured to be worn by or embedded within an animal, in accordance with an embodiment of the disclosure.

FIG. 3 illustrates a detailed diagram of AAA 110*b* of FIG. 2 configured to be worn by, coupled to, or embedded within an animal ear, in accordance with an embodiment of the disclosure. As shown in FIG. 3, AAA 110*b* includes audio transceiver 122, speaker 123, and microphone 124 (audio system 121, inclusively), which may be configured to generate animal-audible sounds and deliver them into the ear canal of an animal via ear hook 310 and earmold 323 (a flexible acoustic diverter, inclusively). In embodiments where AAA 110*b* is mechanically secured to an ear of an animal (e.g., via permanent magnets, adhesive, and/or other mechanical coupling techniques), ear hook 310 may be configured to link speaker 123 of AAA 110*b* secured to the outside of the ear to earmold 323 inserted into the inner ear canal of the animal. In such embodiments, ear hook 310 may be configured to at least partially support the weight of AAA 110*b* as it hangs from the ear of the animal. In embodiments where AAA 110*b* is at least partially subdermally implanted into an ear of an animal, ear hook 310 may be configured to route sounds generated by speaker 123 to a portion of the ear proximate the ear canal of the animal and underneath the skin of the ear.

Figure 4:
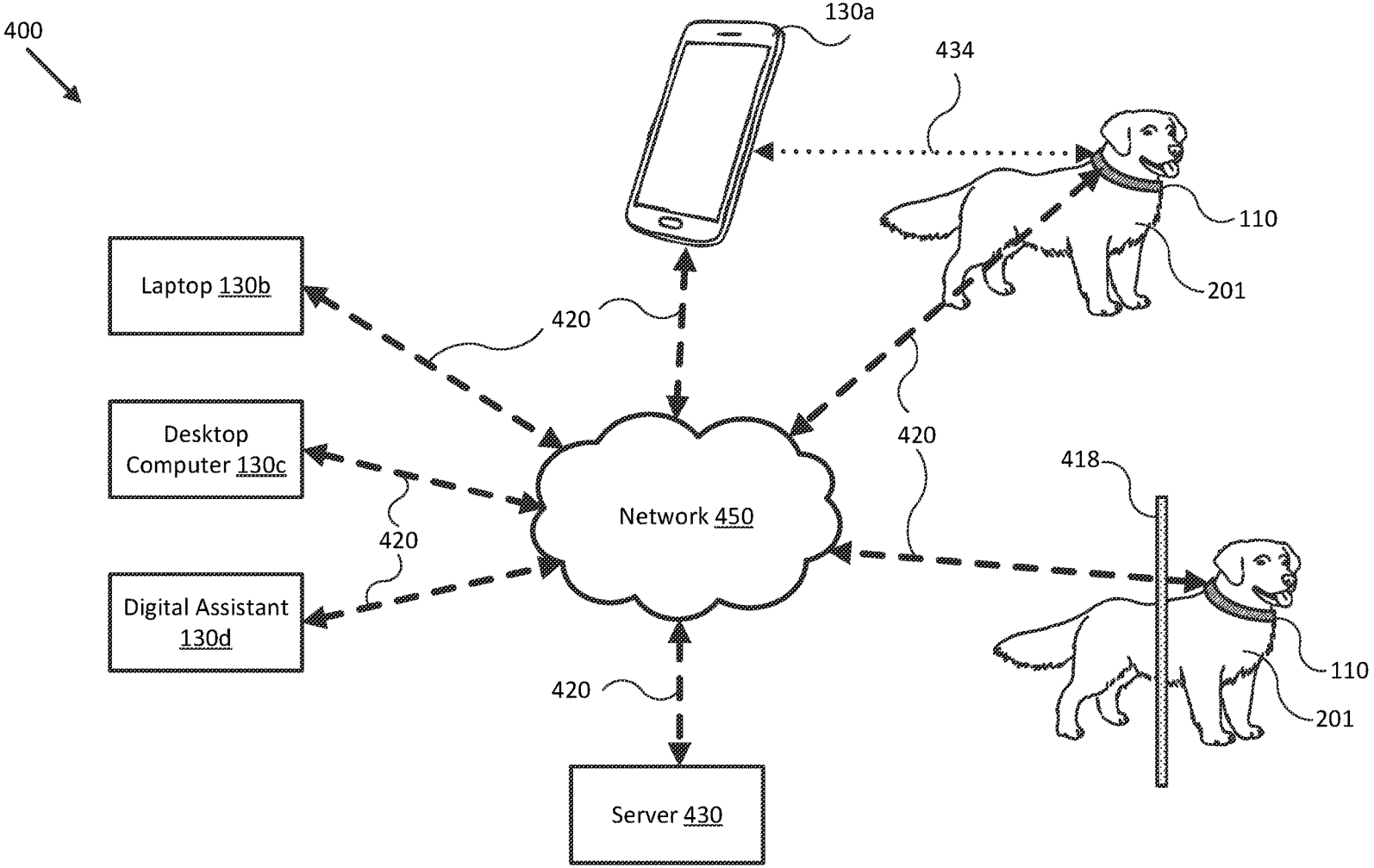
FIG. 4 illustrates a diagram of an animal acoustic augmentation system including multiple AAAs worn by animals, in accordance with an embodiment of the disclosure.

FIG. 4 illustrates a diagram of an animal acoustic augmentation system 400 including multiple AAAs 110 worn by animals 201, in accordance with an embodiment of the disclosure. As shown in FIG. 4, system 400 includes a first animal 201 with a collar AAA 110 in bidirectional communication with personal electronic device 130*a* (e.g., a smart phone) via a direct wireless communication link 434 (e.g., a Wi-Fi, Bluetooth, Zigbee, Xbee, NFC, RFID, or other direct wireless communication link) formed via communications modules 120 and 134, for example, and in bidirectional communication with one or more of personal electronic devices 130*b-d* (e.g., a laptop, desktop computer, and/or digital assistant) and/or server 430 over network 450. In FIG. 4, network 450 may represent one or more wired and/or wireless local or wide area networks, including one or more cellular WANs and/or the Internet. Also shown in FIG. 4 is a second animal 210 with a collar AAA 110 that is outside a perimeter 418 (e.g., a virtual geographic perimeter defined by user input provided to one or more of personal electronic devices 130*a-d* and/or server 430).

In various embodiments, server 430 may be operated by a manufacturer of system 400, for example, and be used to update firmware and/or application software and/or features across one or more of AAAs 110 and/or personal electronic devices 130*a-d*. In other embodiments, server 430 may be operated by an animal trainer or manager employed to train or manage animals 210, as described herein. In further embodiments, server 430 may be configured to receive and store for later retrieval various telemetry data from each AAA 110, for example, such as periodic location data (e.g., provided by GNSS 118), motion data (e.g., provided by gyroscope/accelerometer 116), image and/or video data (e.g., provided by imaging module 119), audio data (e.g., provided by audio system 121), other environmental and/or sensor data (e.g., provided by elements of AAA 110), and/or control sequence data (e.g., generated and/or provided by controller 112 and/or personal electronic device 130). Moreover, copies of such telemetry data may also be stored in memory 111 of AAA 110, such as a backup and/or when or while access to server 430 is unavailable. Regardless of source, such telemetry data may be retrieved, viewed, and/or otherwise managed via personal electronic device 130, as described herein.

Figure 5:
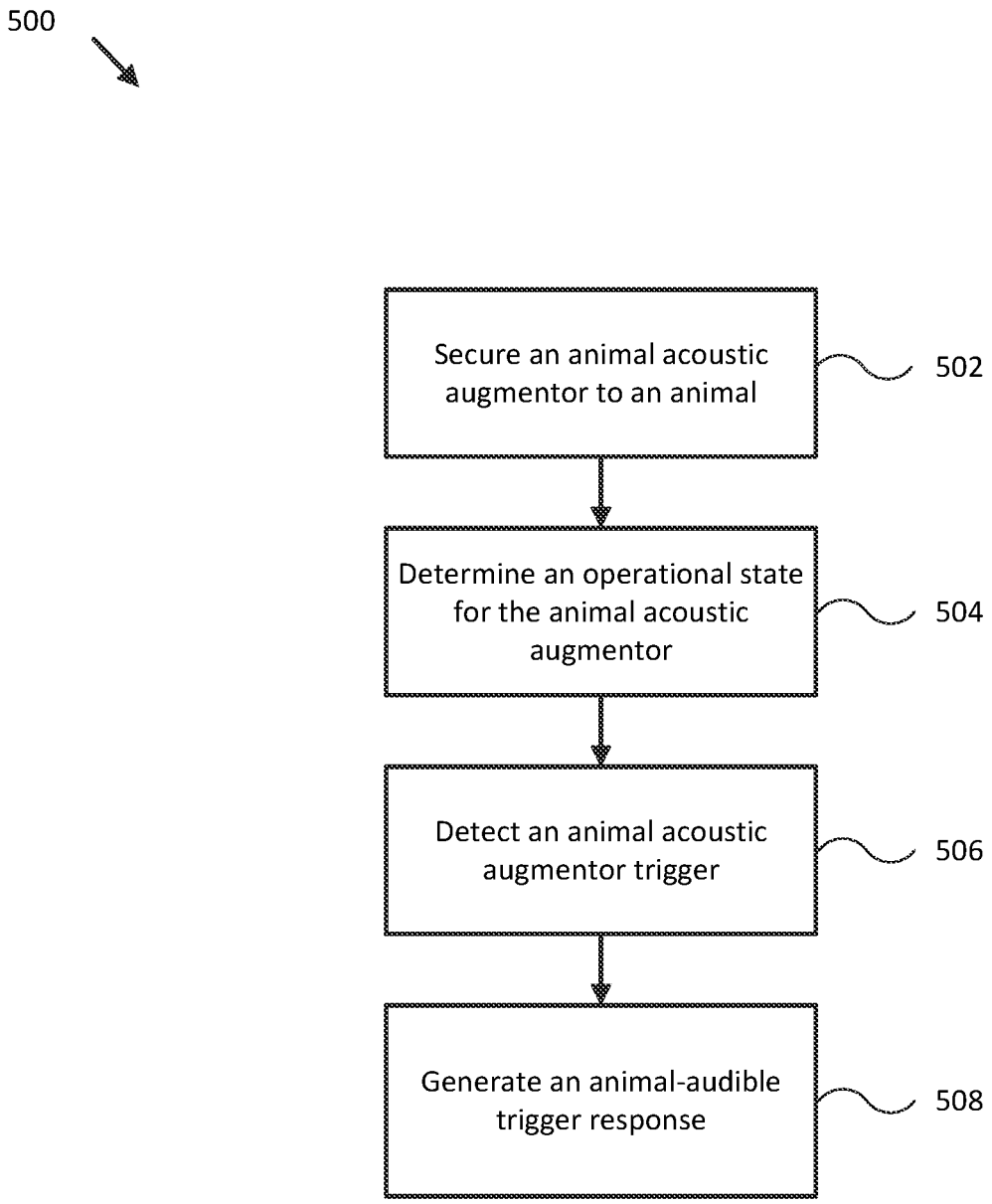
FIG. 5 is a flow diagram illustrating a process for operating an animal acoustic augmentation system including one or more AAAs, in accordance with one or more embodiments of the disclosure.

FIG. 5 is a flow diagram illustrating a process for operating an animal acoustic augmentation system including one or more AAAs, in accordance with one or more embodiments of the disclosure. In particular, process 500 illustrates operation of AAA 110 within animal acoustic augmentation systems 100, 200, and/or 400. In various embodiments, the operations of FIG. 5 may be implemented as software instructions executed by one or more logic devices or controllers associated with corresponding methods, electronic devices, sensors, and/or structures depicted in FIGS. 1-4. More generally, the operations of FIG. 5 may be implemented with any combination of software instructions, mechanical elements, and/or electronic hardware (e.g., inductors, capacitors, amplifiers, actuators, or other analog and/or digital components). Any step, sub-step, sub-process, or block of process 500 may be performed in an order or arrangement different from the embodiment illustrated by FIG. 5, and process 500 may be implemented as a control loop configured to iterate through one or more steps, sub-steps, sub-processes, or blocks of process 500 and return to a previous step, sub-step, sub-process, or block of process 500 to iterate through process 500 one or more additional times. For example, in other embodiments, one or more blocks may be omitted from or added to process 500. Furthermore, block inputs, block outputs, various sensor signals, sensor information, calibration parameters, and/or other operational parameters may be stored to one or more memories prior to moving to a following portion of a corresponding process. Although process 500 is described with reference to systems and methods described in FIGS. 1-4, process 500 may be performed by other systems different from those systems and including a different selection of electronic devices, sensors, assemblies, mechanisms, systems, and/or system attributes.

At block 502, an AAA is secured to an animal. For example, collar AAA 110*a* of FIG. 2 may be belted, strapped, harnessed, or otherwise secured about a neck and/or torso of animal 201. In alternative embodiments, AAA 110*b* may be fully or partially subdermally implanted proximate an ear of animal 201, for example, or mechanically secured to the ear of animal 201, as described herein.

At block 504, an operational state of an AAA is determined. For example, controller 112 of AAA 110 may be configured to determine an operational state of AAA 110 based, at least in part, on a control sequence (corresponding to user input provided to user interface 132) transmitted by personal electronic device 130 and received by AAA 110. In some embodiments, the control sequence may select a hearing enhancement operational state for AAA 110, where AAA 110 is configured to monitor ambient sound about animal 201 and amplify and playback ambient sound above a predetermined threshold level and deliver it to the ear of animal 201. In other embodiments, the control sequence may select an autonomous training operational state for AAA 110, where AAA 110 is configured to monitor environmental sensor data generated by one or more sensors integrated with AAA 110 for an automated training trigger (e.g., a position, motion, lack of motion, and/or undesirable sound uttered by animal 201) and generate a corresponding preprogrammed animal-audible trigger response, as described herein. In further embodiments, the control sequence may select a direct control operational state for AAA 110, where AAA 110 is configured to receive live audio from personal electronic device 130 and playback the live audio via audio system 121, as described herein. Such direct control operational state for AAA 110 may include where AAA 110 is configured to receive a control sequence from personal electronic device 130 to access live audio and/or video/imagery captured by AAA 110, such that a user of personal electronic device 130 may listen and/or view the environment of animal 201 substantially in real time and/or enable two-way communications with animal 201 and/or third parties within range of audio system 121 of AAA 110.

At block 506, an AAA trigger is detected. For example, controller 112 of AAA 110 may be configured to detect an AAA trigger associated with operation of AAA 110, audio system 121 of AAA 110, and/or animal acoustic augmentation system 100, 200, or 400, as describe herein. In some embodiments, controller 112 may be configured to receive audio data captured by audio system 121, and the detecting the AAA trigger may include detecting live ambient audio within the captured audio data with a volume level above a predetermined volume level threshold (e.g., to facilitate hearing enhancement of significant ambient sounds), detecting live ambient audio within the captured audio data corresponding to a stressing sound, such as fireworks, a gunshot, loud vehicle sounds, and/or other sounds typically causing stress within an animal, and/or detecting animal sounds uttered by the animal within the captured audio data, such as relatively high pitched, loud, and/or frequent animal sounds typically indicative of a crisis, such as an intruder or an injury to the animal or an owner or family member. In some embodiments, the detecting the AAA trigger may include detecting activation of a button or other user interface device of AAA 110 (e.g., other modules 128), such as a "contact my owner" button on collar 110*b*, by a third party attempting to notify a user or owner of personal electronic device 130 that animal 201 is in distress and/or the presence of an owner of animal 201 is desired, as described herein.

In embodiments where AAA 110 includes GNSS 118, the detecting the AAA trigger may include detecting an absolute position of AAA 110 and/or animal 201 is approaching or is outside a preselected geographical perimeter (e.g., preselected by user input supplied to user interface 132 of personal electronic device 130). In embodiments where AAA 110 includes gyroscope/accelerometer 114, the detecting the AAA trigger may include detecting undesirable animal motion based, at least in part, on motion sensor data provided by gyroscope/accelerometer 114, for example, and/or may include detecting animal motion below a fitness threshold (e.g., set by user input) based, at least in part, on the motion sensor data provided by gyroscope/accelerometer 114. In embodiments where AAA 110 includes imaging module 119, the detecting the AAA trigger may include receiving a command sequence from personal electronic device 130 causing controller 130 to begin capturing image data provided by imaging module 119. In embodiments where AAA 110 includes barometer 126 and/or temperature sensor 127, the detecting the AAA trigger may include detecting a temporal pressure and/or temperature gradient above a maximum threshold gradient (e.g., set by user input) based, at least in part, on sensor data provided by barometer 126 and/or temperature sensor 127. In embodiments where system 100, 200, and/or 400 include scratch sensor 140, the detecting the AAA trigger may include detecting scratch sensor 140 is within a predefined minimum safety range (e.g., set by user input) of AAA 110.

At block 508, an animal-audible trigger response is generated. For example, controller 112 of AAA 110 may be configured to generate an animal-audible trigger response via audio system 121 of AAA 110 based, at least in part, on the AAA trigger detected in block 506. In various embodiments, such animal-audible trigger response may include a preprogrammed AAA trigger response stored within memory 111 of AAA 110 and/or a live AAA trigger response based, at least in part, on a control sequence and/or an owner command provided by personal electronic device 130 associated with AAA 110 and/or system 100 and/or with an acoustic environment of animal 201.

In some embodiments, controller 112 may be configured to receive audio data captured by audio system 121, and the generating the animal-audible trigger response may include amplifying detected live ambient audio and playing back the amplified live ambient audio via audio system 121 proximal and/or for delivery to the ear of animal 201, retrieving the preprogrammed AAA trigger response stored within memory 111 of AAA 110, where the preprogrammed AAA trigger response comprises a destressing sound (e.g., an owners voice, white noise, and/or low tone/frequency music or audible frequencies), and/or retrieving the preprogrammed AAA trigger response stored within memory 111 of AAA 110, wherein the preprogrammed AAA trigger response comprises an owner command (e.g., a command for the animal to cease uttering the animal sounds and/or to halt motion). Such animal sounds uttered by the animal may include relatively high pitched, loud, and/or frequent animal sounds indicative of a crisis, for example, and controller 112 may be configured to transmit a distressed animal alert to personal electronic device 130 via a communication link established via communications module 120 of AAA 110, as described herein, in order to alert the user/owner that the animal sounds distressed and may need physical attention or further monitoring.

In embodiments where AAA 110 includes GNSS 118, the generating the animal-audible trigger response may include retrieving a preprogrammed AAA trigger response stored within memory 111 of AAA 110, where the preprogrammed AAA trigger response includes an owner command configured to encourage animal 201 to reenter the preselected geographical perimeter, such as a command to go home, stop, or sit, a command to return for food, or a command to protect the perimeter, for example. In embodiments where AAA 110 includes gyroscope/accelerometer 114, the generating the animal-audible trigger response may include retrieving a preprogrammed AAA trigger response stored within memory 111 of AAA 110, where the preprogrammed AAA trigger response includes an owner command configured to discourage animal 201 from continuing the undesirable animal motion (e.g., jumping on a person or a forbidden surface, biting or fighting, and/or other undesirable animal motion), such as a command to go home, stop, or sit, a command to return for food, or a command to lay down, for example. In similar embodiments, the generating the animal-audible trigger response may include retrieving a preprogrammed AAA trigger response stored within memory 111 of AAA 110, where the preprogrammed AAA trigger response includes an owner command configured to encourage the animal to increase animal motion above a fitness threshold, such as an owner command to play or chase or retrieve items. AAA 110 may be configured to supplement any of such animal-audible trigger responses with a dissuading and/or encouraging haptic device response, as described herein.

In embodiments where AAA 110 includes imaging module 119, the generating the animal-audible trigger response may include retrieving a preprogrammed AAA trigger response stored within memory 111 of AAA 110 or receiving a live AAA trigger response from personal electronic device 130 via communications module 120 of AAA 110, where the preprogrammed AAA trigger response or the live AAA trigger response includes an owner or user command to seek out a monitoring target, such as a family member or an intruder. For example, a service animal for a family member may bark excitedly and trigger a distressed animal alert that is received by a user. The user may issue a remote command sequence enabling imaging module 119 and then issue an owner command (either preprogrammed or live) for the animal to seek out the family member benefitting from the service animal. The user can monitor the video feed from imaging module 119 to assess the health and safety of the family member and/or the premises remotely.

In related embodiments, the controller 112 and personal electronic device 130 may be configured to establish two-way audio communications between the two devices, which may be used to supplement and/or provide an alternate methodology to monitor the health and safety of the family member benefitting from the service animal. More generally, controller 112 and/or personal electronic device 130 may be configured to establish such two-way audio communications between the two devices so as to assist in the recovery of a lost or wayward animal 201 in possession of a third party, including an animal control service employee. Such two-way audio communications may be initiated by an owner attempting to local a lost animal, for example, or may be initiated by a third party activating a button (e.g., other modules 128, which may be labeled "contact my owner" in high-viz lettering on collar 110*a*, for example) on AAA 110 configured to alert an owner/user of personal electronic device 130 that animal 201 is in distress and/or is otherwise in need of the presence of the owner or contact with the owner is desired.

In embodiments where AAA 110 includes barometer 126 and/or temperature sensor 127, the generating the animal-audible trigger response may include retrieving preprogrammed AAA trigger response stored within memory 111 of AAA 110, where the preprogrammed AAA trigger response includes a destressing sound, as described herein. Such temporal pressure and/or temperature gradients may be indicative of a crisis, for example, and controller 112 may be configured to transmit a distressed animal alert to personal electronic device 130 via a communication link established via communications module 120 of AAA 110, as described herein, in order to alert the user/owner that the environmental conditions about animal 201 appear unhospitable and may need physical attention or further monitoring. In embodiments where system 100, 200, and/or 400 include scratch sensor 140, the generating the animal-audible trigger response may include retrieving a preprogrammed AAA trigger response stored within memory 111 of AAA 110, where the preprogrammed AAA trigger response comprises a scratch dissuading audible sound (e.g., an owner command, an unpleasant sound, etc.), as described herein. AAA 110 may be configured to supplement any of such animal-audible trigger responses with a dissuading haptic device response, as described herein.

Accordingly, embodiments are able to facilitate the control and/or modification of an animal's behavior through live remote intervention by a user or owner and/or through automated intervention customized and/or selected by the user or owner. Such intervention can distress the animal when the owner is not or cannot be present and can train the behavior of the animal more quickly than alternative means. Moreover, embodiments are additionally able to enhance otherwise degraded hearing while facilitating automated and/or live intervention.

Where applicable, various embodiments provided by the present disclosure can be implemented using hardware, software, or combinations of hardware and software. Also, where applicable, the various hardware components and/or software components set forth herein can be combined into composite components comprising software, hardware, and/or both without departing from the spirit of the present disclosure. Where applicable, the various hardware components and/or software components set forth herein can be separated into sub-components comprising software, hardware, or both without departing from the spirit of the present disclosure. In addition, where applicable, it is contemplated that software components can be implemented as hardware components, and vice-versa.

Software in accordance with the present disclosure, such as non-transitory instructions, program code, and/or data, can be stored on one or more non-transitory machine-readable mediums. It is also contemplated that software identified herein can be implemented using one or more general purpose or specific purpose computers and/or computer systems, networked and/or otherwise. Where applicable, the ordering of various steps described herein can be changed, combined into composite steps, and/or separated into sub-steps to provide features described herein.

The foregoing disclosure is not intended to limit the present disclosure to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize that changes may be made in form and detail without departing from the scope of the present disclosure. Thus, the present disclosure is limited only by the claims.

The invention claimed is:

1. An animal acoustic augmentor (AAA) for an animal acoustic augmentation system, the AAA comprising:

an audio system configured to:

receive audio corresponding to an environment about an animal, wherein the audio corresponding to the environment does not include audio produced by the animal or the AAA; and generate and provide audio proximal to an ear of an animal; and a logic device configured to communicate with and control operation of the audio system, wherein the logic device is configured to:

detect an AAA trigger associated with operation of the AAA and/or the audio system and based, at least in part, on the received audio; and generate an animal-audible trigger response via the audio system of the AAA based, at least in part, on the detected AAA trigger, wherein the animal-audible trigger response comprises a preprogrammed AAA trigger response stored within a memory of the AAA and/or a live AAA trigger response based, at least in part, on a control sequence and/or a command provided by a personal electronic device associated with the AAA, and wherein the animal-audible trigger response comprises a distressing sound.

2. The AAA of claim 1, further comprising a sensor configured to provide sensor data associated with the environment and/or the animal, wherein the AAA trigger is detected based, at least in part, on the sensor data.

3. The AAA of claim 2, wherein the logic device is configured to:

transmit a distressed animal alert to the personal electronic device in response to the sensor data; and receive the command from the personal electronic device after transmission of the distressed animal alert by the logic device, wherein the animal-audible trigger response comprises the live AAA trigger response generated based on the command.

4. The AAA of claim 2, wherein the sensor comprises a barometer configured to provide an ambient pressure associated with the environment and/or a temperature sensor configured to provide a temperature associated with the environment, and wherein the AAA trigger is further based on the ambient pressure and/or the temperature.

5. The AAA of claim 1, wherein the AAA trigger is further based on a location of the animal relative to an owner of the animal.

6. The AAA of claim 5, wherein the distressing sound comprises white noise, music, a voice of the owner, and/or sound at predetermined frequencies, and wherein the location of the owner is in a vehicle and the location of the animal is in a cargo of the vehicle.

7. The AAA of claim 5, wherein the distressing sound is provided via the audio system for a duration starting at each of a plurality of preprogrammed times, and wherein each duration that starts at one of the plurality of preprogrammed times is followed by a duration in which the distressing sound is not provided via the audio system.

8. The AAA of claim 1, wherein the received audio corresponding to the environment comprises one or more sounds associated with a gunshot, fireworks, an airplane, and/or a car horn.

9. The AAA of claim 1, wherein the AAA trigger comprises user input to the AAA, wherein the logic device is further configured to:

transmit data to the personal electronic device in response to the user input; and receive the command from the personal electronic device after transmission of the data, wherein the animal-audible trigger response provided via the audio system comprises the live AAA trigger response generated based on the command.

10. The AAA of claim 9, further comprising an imaging module configured to capture imagery of the environment in response to the user input, and wherein the logic device is configured to generate the animal-audible trigger response to communicate with the animal and/or a person in the environment.

11. The AAA of claim 9, wherein the logic device is configured to generate the animal-audible trigger response to communicate with the animal and/or a provider of the user input.

12. The AAA of claim 1, further comprising a motion sensor configured to provide motion sensor data indicative of motion of the animal, wherein the AAA trigger is further based on the motion sensor data, and wherein the animal-audible trigger response further comprises a sound to encourage or discourage the motion of the animal.

13. The AAA of claim 1, further comprising a global navigation satellite system receiver configured to provide an absolute position of the AAA and/or the animal, wherein the AAA trigger is based on the absolute position of the AAA and/or the animal relative to a preselected geographical perimeter, wherein the logic device is configured transmit an alert to the personal electronic device in response to the AAA trigger; and receive the command from the personal electronic device after transmission of the alert, wherein the animal-audible trigger response comprises the live AAA trigger response generated based on the command to communicate instructions associated with the preselected geographical perimeter to the animal.

14. A method of operating an animal acoustic augmentor (AAA) for an animal acoustic augmentation system, the method comprising:

detecting an AAA trigger associated with operation of the AAA and/or an audio system and based, at least in part, on received audio corresponding to an environment about an animal, wherein the audio system is configured to generate audio proximal to an ear of the animal and receive the audio corresponding to the environment about the animal, wherein the received audio does not include audio produced by the animal or the AAA; and generating an animal-audible trigger response via the audio system based, at least in part, on the detected AAA trigger, wherein the animal-audible trigger response comprises a preprogrammed AAA trigger response stored within a memory of the AAA and/or a live AAA trigger response based, at least in part, on a control sequence and/or a command provided by a personal electronic device associated with the AAA, and wherein the animal-audible trigger response comprises a distressing sound.

15. The method of claim 14, further comprising:

capturing sensor data associated with the environment and/or the animal, wherein the AAA trigger is detected based, at least in part, on the sensor data;

transmitting a distressed animal alert to the personal electronic device in response to the sensor data; and receive the command from the personal electronic device after transmission of the distressed animal alert, wherein the animal-audible trigger response comprises the live AAA trigger response generated based on the command.

16. The method of claim 14, wherein the AAA trigger is further based on a location of the animal relative to an owner of the animal, and wherein the location of the owner is in a vehicle and the location of the animal is in a cargo of the vehicle.

17. The method of claim 16, wherein the distressing sound is provided via the audio system for a duration starting at each of a plurality of preprogrammed times, and wherein each duration that starts at one of the plurality of preprogrammed times is followed by a duration in which the destressing sound is not provided via the audio system.

18. The method of claim 14, wherein the AAA trigger comprises user input to the AAA, the method further comprising:

transmitting data to the personal electronic device in response to the user input;

receive the command from the personal electronic device after transmission of the data, wherein the animal-audible trigger response provided via the audio system comprises the live AAA trigger response generated based on the command; and capturing imagery of the environment in response to the user input, wherein the animal-audible trigger response is generated to communicate with the animal and/or a person in the environment.

19. The method of claim 14, wherein the AAA trigger is based on an absolute position of the AAA and/or the animal relative to a preselected geographical perimeter, the method further comprising:

transmitting an alert to the personal electronic device in response to the AAA trigger; and receiving the command from the personal electronic device after transmission of the alert, wherein the animal-audible trigger response comprises the live AAA trigger response generated based on the command to communicate instructions associated with the preselected geographical perimeter to the animal.

20. The method of claim 14, wherein the received audio corresponding to the environment comprises one or more sounds associated with a gunshot, fireworks, an airplane, and/or a car horn.

* * * * *